US006193940B1

(12) United States Patent
Kang et al.

(10) Patent No.: US 6,193,940 B1
(45) Date of Patent: Feb. 27, 2001

(54) FIRING SYSTEM FOR THE IMPROVED PERFORMANCE OF ETHYLENE CRACKING FURNACES

(75) Inventors: Shin G. Kang, Simsbury; Galen H. Richards, Torrington; Majed A. Toqan, Avon, all of CT (US); Dieter Winkler, Lauchringen (DE)

(73) Assignee: ABB Alstom Power Inc., Windsor, CT (US)

( * ) Notice: Subject to any disclaimer, the term of this patent is extended or adjusted under 35 U.S.C. 154(b) by 0 days.

(21) Appl. No.: 09/217,210

(22) Filed: Dec. 21, 1998

(51) Int. Cl.[7] ..... F28D 21/00; F23C 5/00; F23N 5/00

(52) U.S. Cl. ..... 422/198; 110/185; 431/8; 431/351

(58) Field of Search ..... 422/198, 199, 422/200; 110/186, 101 CF, 185, 187, 188, 208, 205; 431/8, 9, 10, 351–353, 285

(56) References Cited

U.S. PATENT DOCUMENTS 3,706,445 * 12/1972 Gentry ..... 432/72
5,156,098 * 10/1992 Camp ..... 110/238
5,394,837 * 3/1995 Tsai et al. ..... 122/235.23

* cited by examiner

*Primary Examiner*—Jacqueline V. Howard
*Assistant Examiner*—Alexa A. Doroshenk
(74) *Attorney, Agent, or Firm*—Russell W. Warnock

(57) ABSTRACT

A firing system for a thermal cracking furnace is provided. The firing system includes a plurality of air inlets for introducing air into the furnace interior, the air inlets being generally arrayed along a lengthwise row on the floor of the furnace at a predetermined proximity to one of the sidewalls, and a plurality of start up fuel ports disposed intermediate the row of air inlets and the radiant coils of the furnace. The firing system also includes a plurality of normal operation fuel ports disposed intermediate the row of start up ports and the radiant coils and an assembly for selectively controlling the overall supply of fuel to the start up fuel ports and the normal fuel operation ports to effect supply of fuel solely to the start up fuel ports during a start up mode of operation of the firing system and supply of fuel solely to the normal operation fuel ports during a normal mode of operation.

9 Claims, 13 Drawing Sheets

FIRING SYSTEM FOR THE IMPROVED PERFORMANCE OF ETHYLENE CRACKING FURNACES

BACKGROUND OF THE INVENTION

The present invention relates to a firing system for a thermal cracking furnace and, more particularly, a firing system for a thermal cracking furnace of the type having hearth burners for heating radiant walls of the furnace to thereby effect heating by radiation of radiant coils.

A thermal cracking furnace thermally cracks a hydrocarbon feedstock such as naphtha, ethane, and propane during circulation of the feedstock through radiant coils suspended within the furnace. Coke and tar products produced by pyrolysis of the hydrocarbon feedstock during the cracking process leads to eventual fouling of the radiant coils, necessitating cleaning (decoking) or replacement of the coils. The selectivity, yield, and run lengths between decoking cycles are typically closely related to the heat flux profile along the vertical extent of the radiant coils.

The thermal cracking process involves combustion of a fossil based fuel such as gas in a manner which unavoidably results in the creation of $NO_X$. $NO_X$ emissions are recognized to be a significant source of air pollution. Thus, environmental emissions standards have been and continue to be imposed by various governmental authorities which limit the amount of $NO_X$ gases which can be emitted into the atmosphere. Several designs have been proposed to inhibit the production of $NO_X$ gases including designs which limit the production of $NO_X$ gases due to the mixing of fuel and furnace or flue gases for combustion in a combustion zone of a thermal cracking furnace. Although these designs may be advantageous, there still remains the need for burner designs for a thermal cracking furnace having improved $NO_X$ reduction characteristics.

SUMMARY OF THE INVENTION

The present invention provides, in one aspect thereof, a firing system for a thermal cracking furnace of the type having a furnace enclosure formed by a plurality of sidewalls and plurality of radiant coils disposed in a row in the furnace relative to a lengthwise extent thereof for passage therethrough of a material to be subjected to cracking. The firing system includes a plurality of air inlets for introducing air into the furnace interior, the air inlets being generally arrayed along a lengthwise row on the floor of the furnace at a predetermined proximity to one of the sidewalls as measured along a widthwise extent of the furnace perpendicular to its lengthwise extent, and a plurality of start up ports disposed intermediate the row of air inlets and the radiant coils relative to the widthwise extent of the furnace. The start up ports are generally arrayed along a lengthwise row on the floor of the furnace and being operable to introduce fuel into the furnace.

The firing system of the one aspect of the present invention also includes a plurality of normal operation ports disposed intermediate the row of start up ports and the radiant coils, the normal operation ports being generally arrayed along a lengthwise row on the floor of the furnace and being operable to introduce fuel into the furnace. The firing system further includes means for selectively controlling the overall supply of fuel to the start up ports and the normal operation ports to effect supply of fuel solely to the start up ports during a start up mode of operation of the firing system and supply of fuel solely to the normal operation ports during a normal mode of operation.

DETAILED DESCRIPTION OF THE PREFERRED EMBODIMENTS

Figure 1:
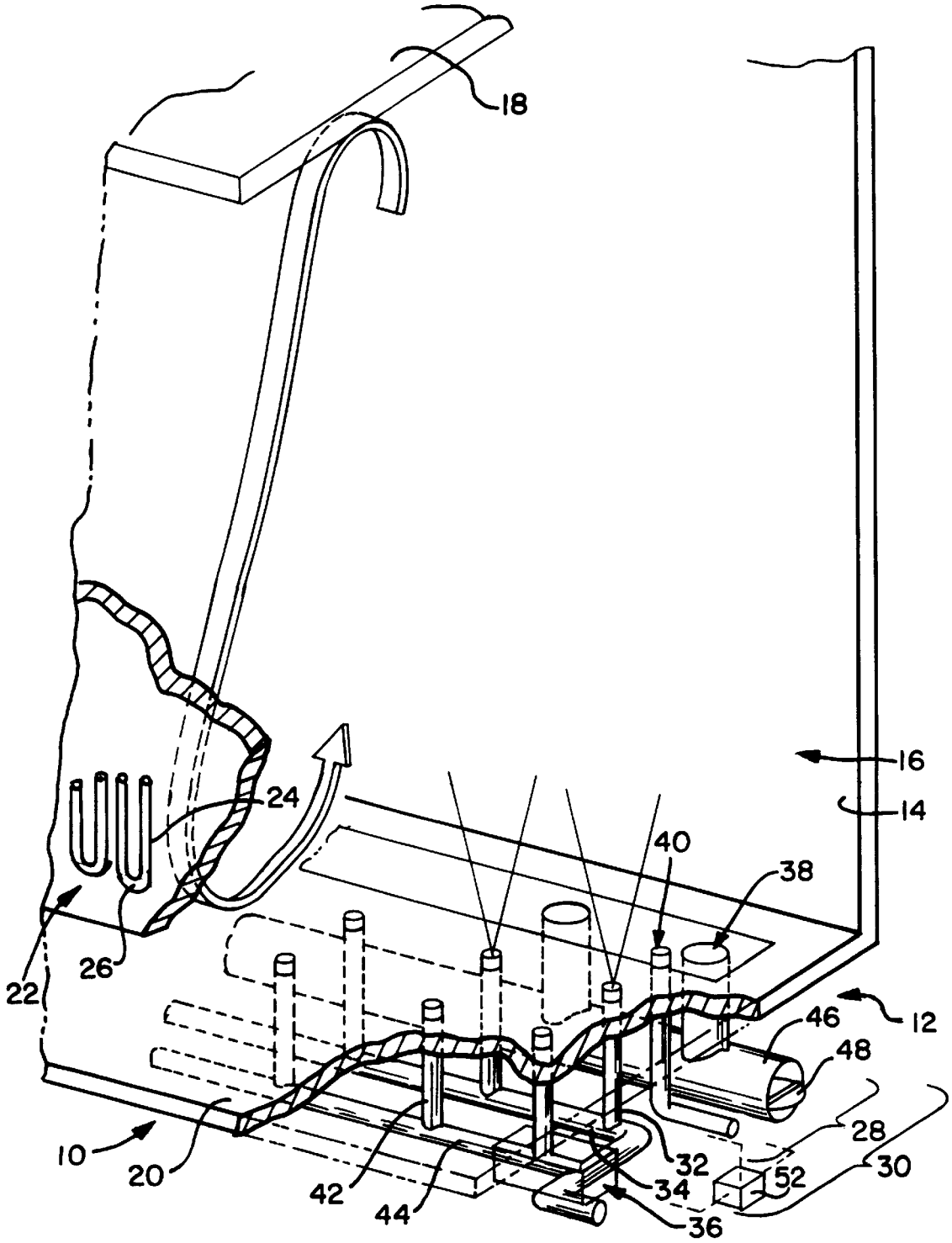
FIG. 1 is a perspective view, in partial horizontal and vertical section, of a thermal cracking furnace having one embodiment of the firing system of the present invention and schematically showing the fuel and air introduced into the furnace interior by the firing system during a start up mode of operation.

As seen in FIG. 1, a furnace 10 for thermally cracking a hydrocarbon feedstock such as ethane is provided with one embodiment of the firing system 12 of the present invention. The furnace 10 includes a plurality of vertically upstanding sidewalls 14 arranged to form a radiant heating zone 16 bounded on its top end by a roof 18 and on its bottom end by a floor 20. The firing system 12 includes components, to be described in more detail shortly, which are located according to a selected configuration of the firing system at either a floor location on the floor 20 or a wall location on one of sidewalls 14.

The furnace 10 also includes a plurality of radiant coils 22 having vertical downcomer sections 24 extending in a vertical plane parallel to one opposed pair of the sidewalls 14 and commonly communicated at their bottom end with a manifold 26 disposed relatively adjacent the floor 20. The hydrocarbon feedstock is distributed to the radiant coils 22 for flow therethrough as the firing system 12 combusts fuel to create radiant heat which elevates the hydrocarbon feedstock in the radiant coils to a temperature typically greater than 1500 degrees F. The radiant coils 22 are subjected to fouling in the form of coke and tar deposits and must therefore be cleaned or replaced in dependence upon the operating time of the furnace 10.

With further reference now to the features of the firing system 12, it can be seen, in FIGS. 1–5, that the one embodiment of the firing system includes a start up fuel subsystem 28 and a normal operation subsystem 30. The start up fuel subsystem 28 is operable to combust a fuel-air-flue gas mixture in a start up mode of the firing system 12 and includes a plurality of start up fuel ports 32 commonly communicated with a start up fuel manifold 34. The start up fuel manifold 34 is communicated at one end with a fuel switching assembly 36. The start up fuel subsystem 28 is also comprised of components which are common to the normal operation subsystem 30 as well—namely, a plurality of main air inlets 38 and a pilot burner 40.

The normal operation subsystem 30 is operable to combust a fuel-air-flue gas mixture during a normal operational mode of the firing system 12 and includes a plurality of operational fuel ports 42 commonly communicated with an operational fuel manifold 44 which is communicated at one end with the fuel switching assembly 36. The normal operation subsystem 30 also shares with the start up subsystem 28 the main air inlets 38 and the pilot burner 40.

The main air inlets 38 are commonly communicated with an air manifold duct 46 which is communicated at one end with an air supply (not shown). A damper assembly 48 is mounted in the one end of the air manifold duct 46 for selectively controlling the volume of air supplied into the furnace 10 through the main air inlets 38.

The pilot burner 40 is communicated with a fuel supply (not shown) for supply of fuel to the pilot burner. A supply pipe communicates the fuel switching assembly 36 with a fuel supply (not shown) such that fuel is continuously supplied to the fuel switching assembly 36 for controlled distribution of the fuel in accordance with a selected fuel distribution mode. The selected fuel distribution modes may include a first mode in which no fuel is supplied to either the start up ports 32 or the normal operation ports 42, a second mode in which fuel is supplied via the start up manifold 34 to the start up ports 32 but not to the normal operation ports 42, a third mode in which fuel is supplied via the normal operation manifold 44 to the normal operation ports 42 but not to the start up ports 32, and a fourth mode in which fuel is supplied to both the start up ports 32 and the normal operation ports 42.

Figure 3:
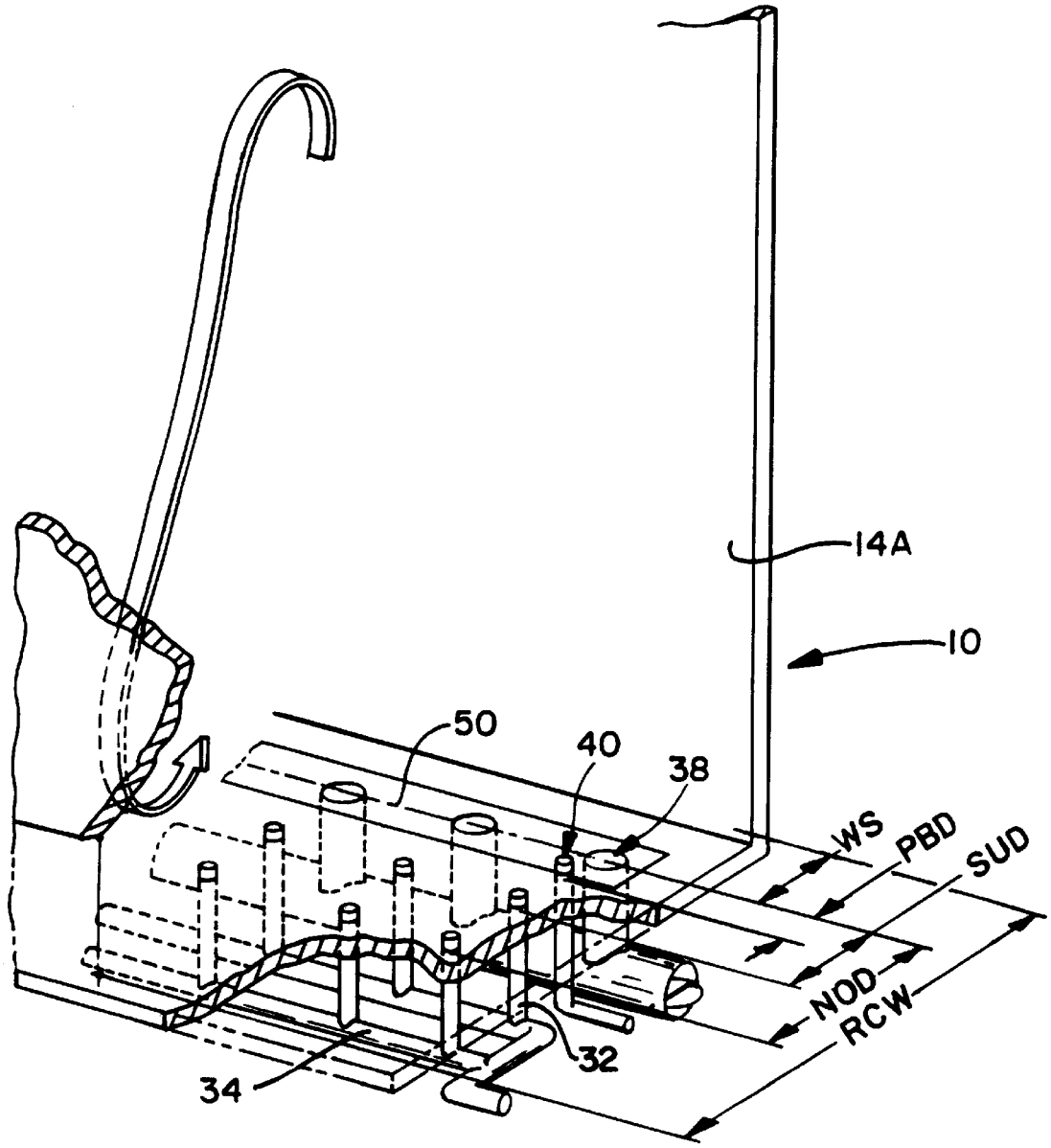
FIG. 3 is a perspective view, in partial horizontal and vertical section, of the thermal cracking furnace having the one embodiment of the firing system of the present invention shown in FIG. 1.
Figure 4A:
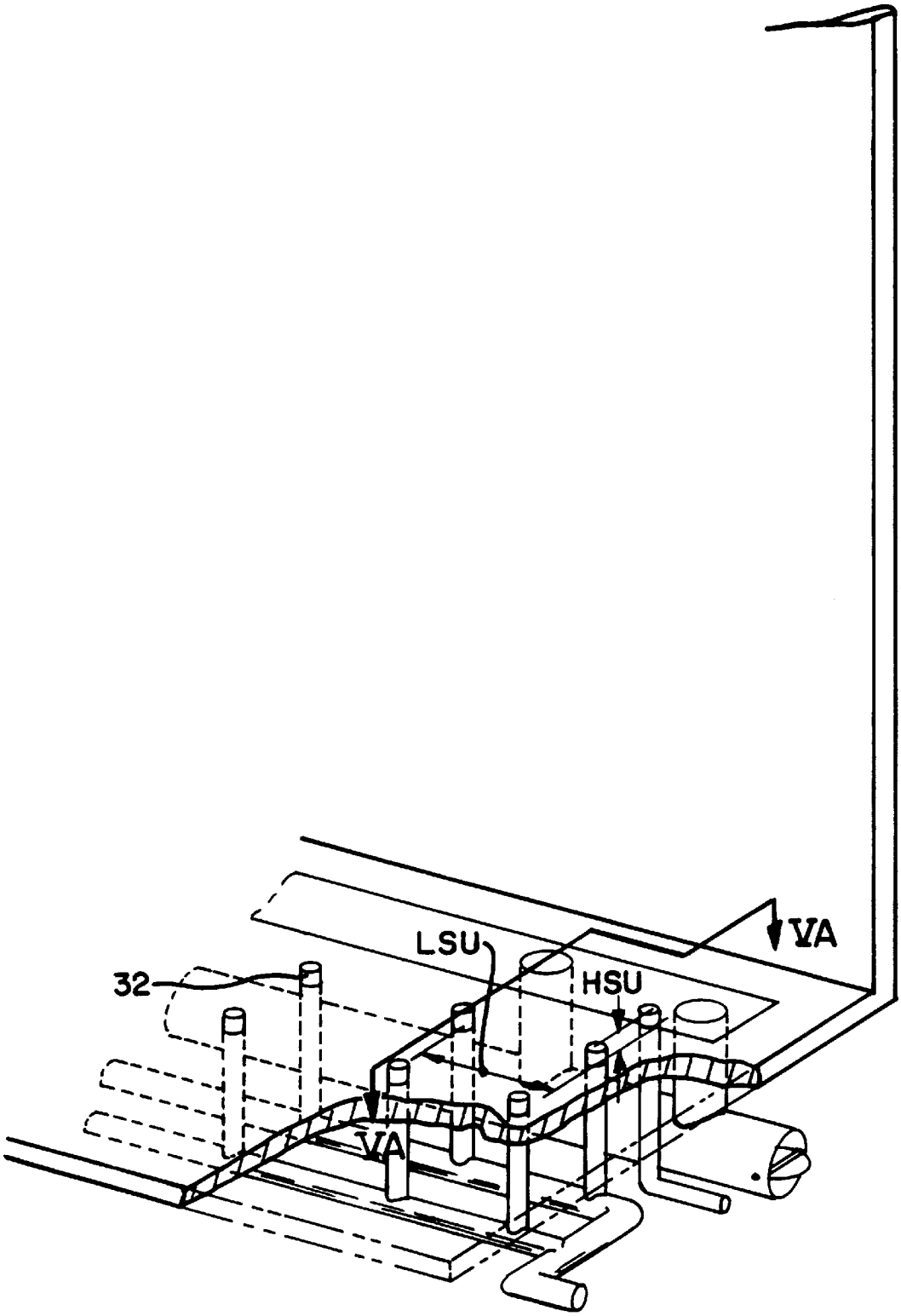
FIG. 4A is an enlarged perspective view of the one embodiment of the firing system of the thermal cracking furnace shown in FIG. 1 and schematically showing the fuel and air introduced into the furnace interior by the firing system during a start up mode of operation.

As seen in FIG. 3, each of the main air inlets 38 is communicated with the furnace interior via a circular open end disposed generally flush with the top surface of the floor 20 and the main air inlets 38 are arranged in a main air inlet row 50 parallel to an adjacent respective sidewall 14, hereinafter designated as the sidewall 14A, at a uniform spacing WS from the sidewall as measured in a furnace width direction perpendicular to the sidewall 14A and the main air inlet row 50. The pilot burner 40 extends vertically beyond the top surface of the floor 20 and is disposed at a width spacing PBD from the main air inlet row 50 such that the pilot burner is sufficiently proximate one of the main air inlets 38 to ensure a reliable pilot burner combustion operation. For example, in one operational configuration, the pilot burner 40 may be positioned relatively closely adjacent an endmost one of the main air inlets 38, such as illustrated in FIG. 3, while, in another operational configuration, the pilot burner 40 may be preferably positioned relatively closely adjacent the centermost one of the main air inlets 38. The start up ports 32, as seen in FIG. 3, are arranged in a row parallel to the main air inlet row 50 at a spacing SUD therefrom relatively greater than the width spacing PBD of the pilot burner 40 from the main air inlet row 50. As seen in FIG. 4A, the start up ports 32 each extend vertically beyond the floor 20 into the furnace interior at a uniform height HSU above the floor 20 and are disposed according to a selected spacing arrangement relative to one another which may be either a uniform or a non uniform spacing arrangement. FIG. 4A illustrates one exemplary spacing arrangement in which the start up ports 32 are disposed at a uniform lengthwise spacing LSU from one another as measured along the start up port row.

Figure 4B:
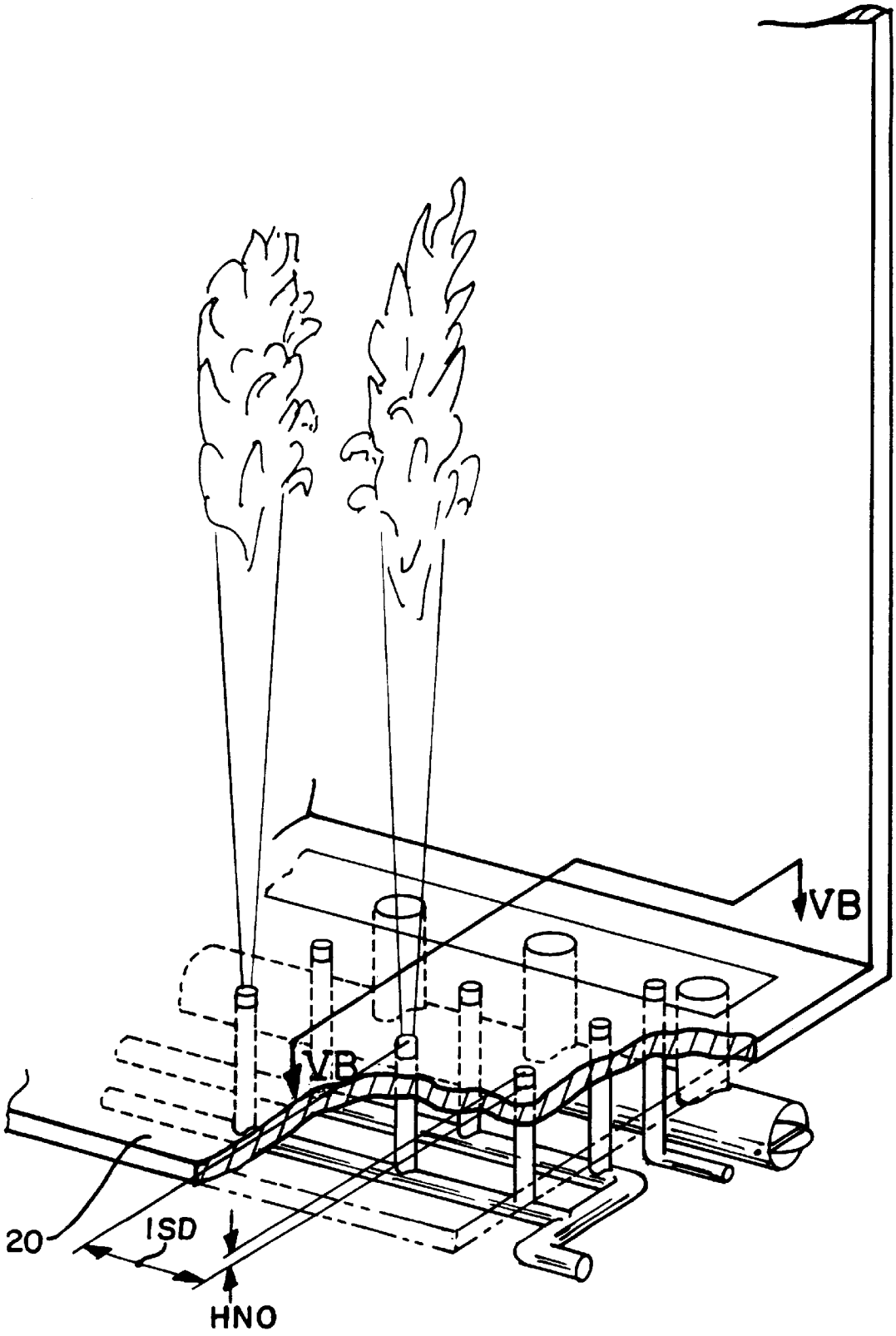
FIG. 4B is an enlarged perspective view of the one embodiment of the firing system of the thermal cracking furnace shown in FIG. 1 and schematically showing the fuel and air introduced into the furnace interior by the firing system during normal operation.

The normal operation ports 42, as seen in FIG. 3, are arranged in a row parallel to the main air inlet row 50 at a width spacing NOD from the main air inlet row 50 relatively greater than the width spacing SUD of the row of the start up ports 32 from the main air inlet row 50. The normal operation ports 42 are disposed according to a selected spacing arrangement relative to one another which may be either a uniform or a non uniform spacing arrangement. FIG. 4B illustrates one exemplary spacing arrangement in which the normal operation ports 42 are disposed at a lengthwise uniform spacing ISD from one another which is preferably aligned with the lengthwise uniform spacing LSU between adjacent ones of the start up ports 32. The normal operation ports 42 extend vertically beyond the floor 20 at a uniform height HNO.

With reference to FIG. 3, several spatial relationships of the firing system components will now be described. A centerline of the radiant coils 22 extending parallel to the sidewall 14A is at a width spacing RCW from the sidewall which is greater than the width spacing NOD of the normal operation ports 42. Several spatial relationships can be defined with respect to this width spacing RCW of the radiant coils 22. Preferably, the sum of the width spacing NOD of the normal operation ports 42 and the width spacing WS of the main air inlet row 50 is between about one-eighth (⅛) of the width spacing RCW of the radiant coils 22 and about three-quarters (¾) of the width spacing RCW of the radiant coils 22, as expressed in the following Equation (1):

$$NOD+WS=\text{a range of between about } \tfrac{1}{8}\,RCW \text{ to about } \tfrac{3}{4}\,RCW \quad (1)$$

Also, the sum of width spacing SUD of the row of the start up ports 32 and the width spacing WS of the main air inlet row 50 is between about one-eighth (⅛) of the width spacing RCW of the radiant coils 22 and about one-half (½) of the width spacing RCW of the radiant coils 22, as expressed in the following Equation (2):

$$SUD+WS = \text{a range between about } \tfrac{1}{8}\ RCW \text{ to about } \tfrac{1}{2}\ RCW \quad (2)$$

The width spacing WS of the main air inlet row 50 preferably ranges from between about zero (0) to about one-half (½) of the width spacing RCW of the radiant coils 22, as expressed in the following Equation (3):

$$WS = \text{a range between about 0 to about } \tfrac{1}{2}\ RCW \quad (3)$$

Additionally, in some operational scenarios, it may be preferred that the firing system components are disposed relative to one another according to the following Equation (4):

$$NOD+WS < SUD+WS \quad (4)$$

Figure 2:
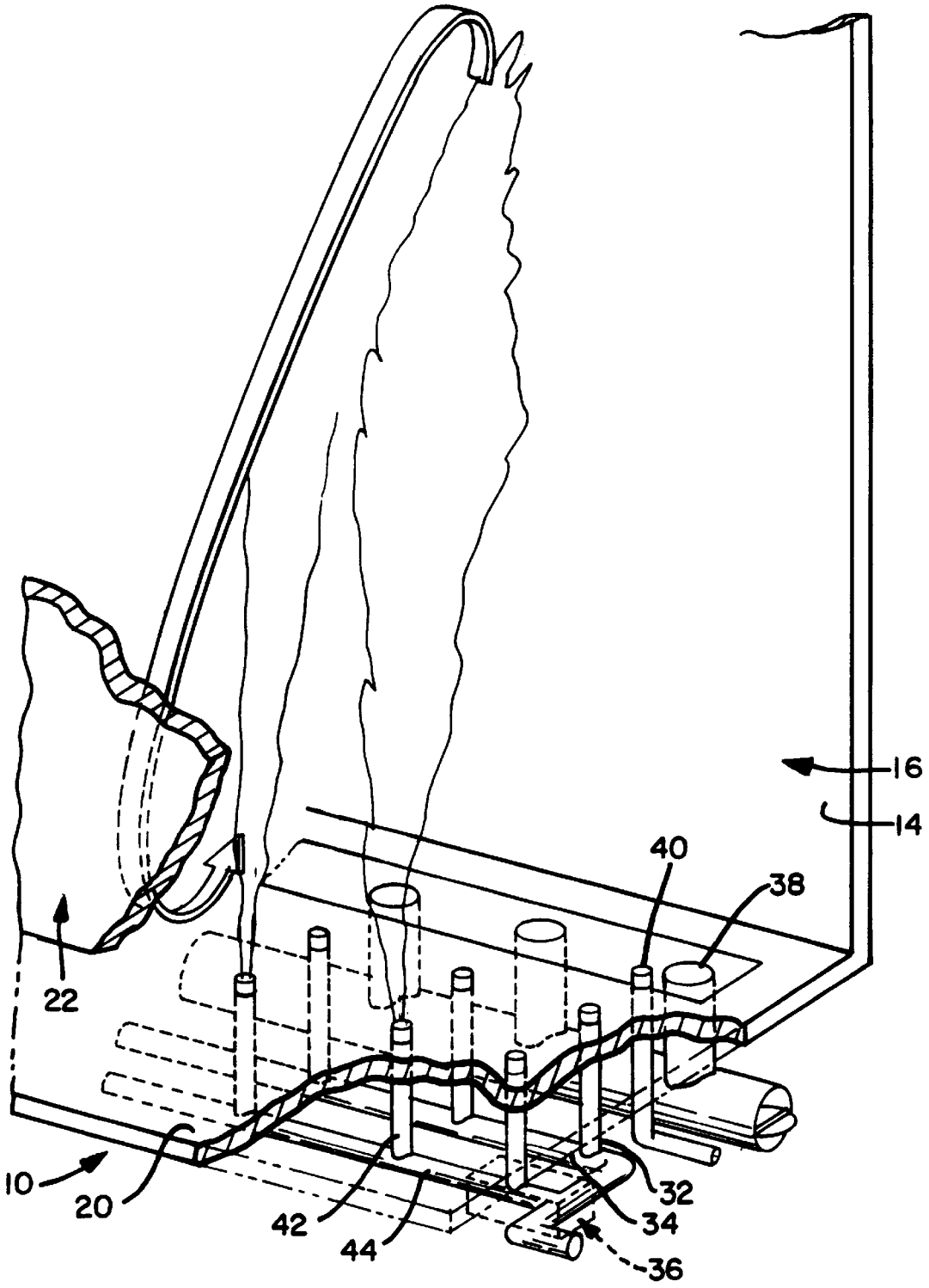
FIG. 2 is a perspective view, in partial horizontal and vertical section, of the thermal cracking furnace having the one embodiment of the firing system of the present invention shown in FIG. 1 and schematically showing the fuel and air introduced into the furnace interior by the firing system during normal operation thereof.

It is contemplated that the one embodiment of the firing system 12 illustrated in FIGS. 1–3 can be operated in its start up mode of operation by manual manipulation of the firing system components in accordance with the start up sequence which will now be described. However, in the interest of exemplarily illustrating the adaptability of the firing system to be operated in a semi-automatic or fully automatic mode of operation, attention is now drawn to FIGS. 4A and 5A in which a fully automatic version of the start up mode of operation of the one embodiment of the firing system 12 is schematically illustrated. The pilot burner 40, the damper assembly 48, and the fuel switching assembly 36 are operatively connected to a controller 52 which may be, for example, a PC-based controller, a programmable logic controller (PLC), or any other suitable controller having the capability to control the supply of air and fuel into the furnace interior as a function of pre-programmed inputs, monitored or measured inputs, or other real-time or interactive inputs relating to characteristics of the thermal cracking process. In the start up mode of operation, the controller 52 controls the damper assembly 48 to move to a more open position from a more closed position to thereby permit the supply of air through the main air inlets 38 into the furnace interior. Additionally, the controller 52 controls the fuel switching assembly 36 to operate in its second fuel distribution mode of operation in which it permits the supply of fuel to the start up ports 32 but not to the normal operation ports 42. The relatively closely adjacent disposition of the start up ports 32 to the pilot burner 40 as well as to the main air inlets 38 ensures that the fuel issued from the start up ports 32 is relatively rapidly mixed with the entering air to create a fuel-air mixture. The fuel-air mixture is additionally joined by flue gas which has been produced during the combustion of the preceding fuel-air mixture and thereafter followed the start up flue gas path 54 shown in FIG. 5A along which the flue gas rises and then circulates downwardly to join with the fuel being introduced by the start up ports 32. Preferably, each of the start up ports 32 is configured with a nozzle having multiple fuel ports oriented to facilitate the issuance of fuel upwardly at an inclination toward the rising air supplied by the main air inlets 38.

The controller 52 may be configured to continue the operation of the firing system 12 in the start up mode just described until receiving a pre-programmed input transmitted, for example, in response to the expiration of a predetermined start up period or another event. For example, an input may be provided to the controller 52 to signal the expiration of a start up period having a predetermined or estimated duration corresponding to a maximum or average period of time for a reference temperature of the furnace interior to reach the auto-ignition temperature of the fuel, whereupon it is desirable to cease the start up mode of operation and switch to the normal mode of operation. Alternatively, the controller 52 may be configured to continue the operation of the firing system 12 in the start up mode until the receipt of a real time or interactive input related to a monitored condition such as, for example, a sensing condition in which a selected temperature of the furnace is sensed. For example, an input may be provided to the controller 52 to cease the start up mode of operation in response to the sensing of a temperature of 1400 degrees F.

In response to the input to cease the start up mode of operation, the controller 52 controls the supply of air and fuel into the furnace interior to thereby implement the normal operation mode. The controller 52 controls the damper assembly 48 to continue the supply of air to the main air inlets 38, controls the pilot burner 40 to continue the pilot flame, and controls the fuel switching assembly 36 to operate in its third fuel distribution mode of operation in which fuel is supplied to the normal operation ports 42 but is not supplied to the start up ports 32. The normal operation mode thus comprises introduction of fuel from the normal operation ports 42 preferably at a relatively slight inclination in the direction toward the sidewall 14A and introduction of combustion air generally vertically through the main air inlets 38. As seen in particular in FIGS. 4B and 5B, the normal operation ports 42 are oriented such that they introduce fuel into the furnace interior along a fuel introduction direction FF (shown in circle-dash line in FIG. 5B) which is at a relatively slight inclination in the direction toward the sidewall 14A and which forms an included mix angle MA with a vertical plane AP passing through the main air inlet row 50 corresponding to the overall direction of flow of the air introduced through the main air inlets 38. In the event that each of the normal operation ports 42 is configured with nozzles having multiple fuel ports, the multiple fuel ports are preferably oriented such that none of these ports introduces fuel into the furnace interior at a greater inclination toward the sidewall 14A than the inclination of the fuel introduction direction FF and, additionally, the majority of the fuel introduced by the normal operation ports 42 is delivered toward the sidewall 14A. Preferably, each of the multiple fuel ports of each such nozzle of a normal operation port 42 is separated from each adjacent fuel port by a spacing at least as great as the diameter of the fuel port.

The fuel introduction direction FF, the vertical plane AP, and a line segment corresponding to the width spacing NOD of the normal operation ports 42 together form a right angle triangle with the fuel introduction direction FF forming the hypotenuse of the triangle and the vertical plane AP and the line segment corresponding to the width spacing NOD of the normal operation ports 42 forming the right angle of the triangle. Thus, the introduced fuel travels generally in the fuel introduction direction FF for some distance before igniting as it mixes with the combustion air traveling generally upwardly along the vertical plane AP. The combustion of the fuel-air mix produces heat which contributes to the heating up of the radiant coils 22 so as to thereby render the thermal cracking process. Also, the combustion of the fuel-air mix produces flue gases which desirably have a relatively low $NO_X$ content achieved through a fuel-air-flue gas dilution arrangement which will now be described in more detail.

Figure 5A:
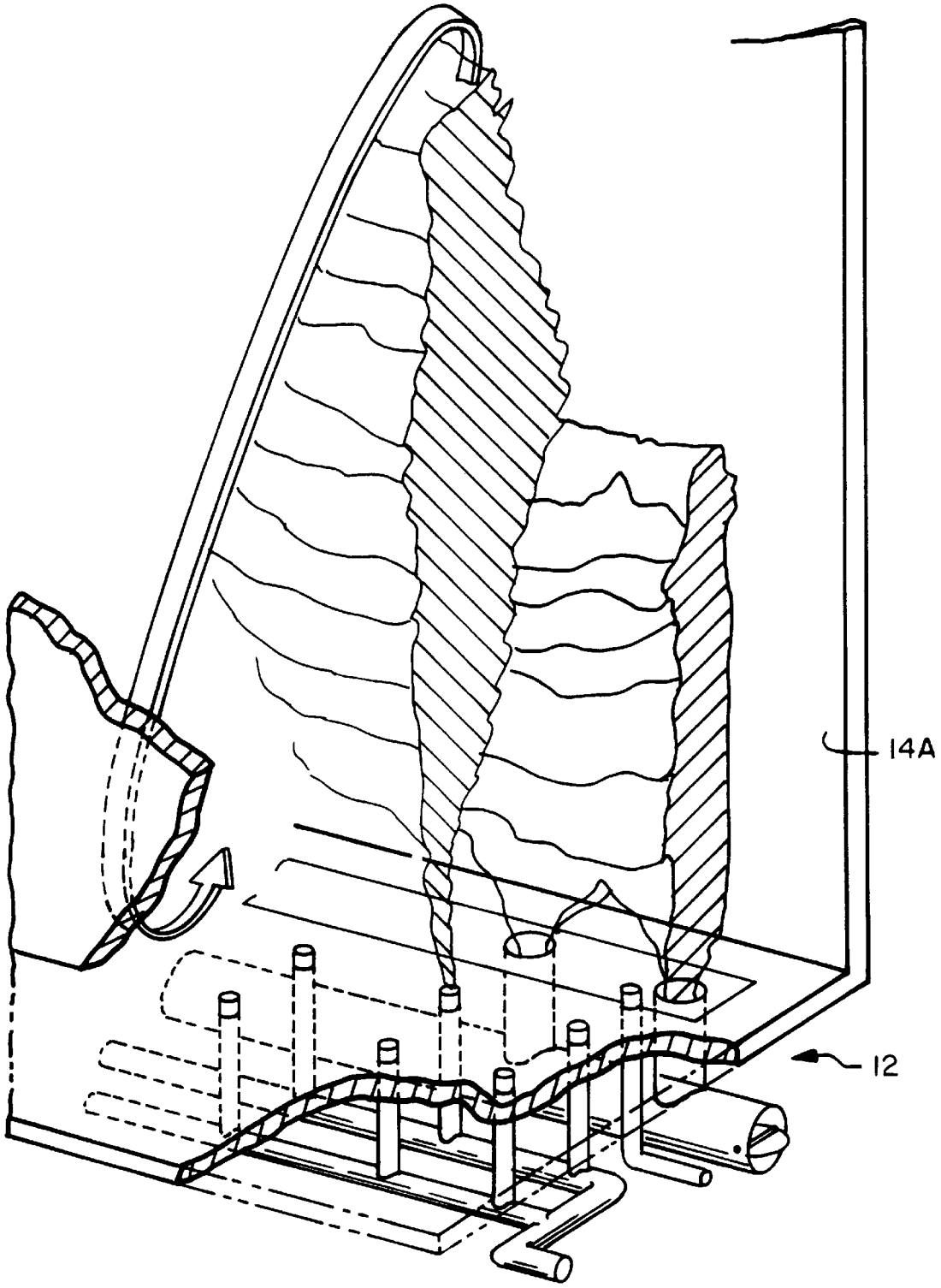
FIG. 5A is a perspective view of the one embodiment of the firing system of the thermal cracking furnace shown in FIG. 4A and schematically showing, in partial vertical section along lines VA—VA shown in FIG. 4A, the fuel and air introduced into the furnace interior by the firing system during a start up mode of operation.
Figure 5B:
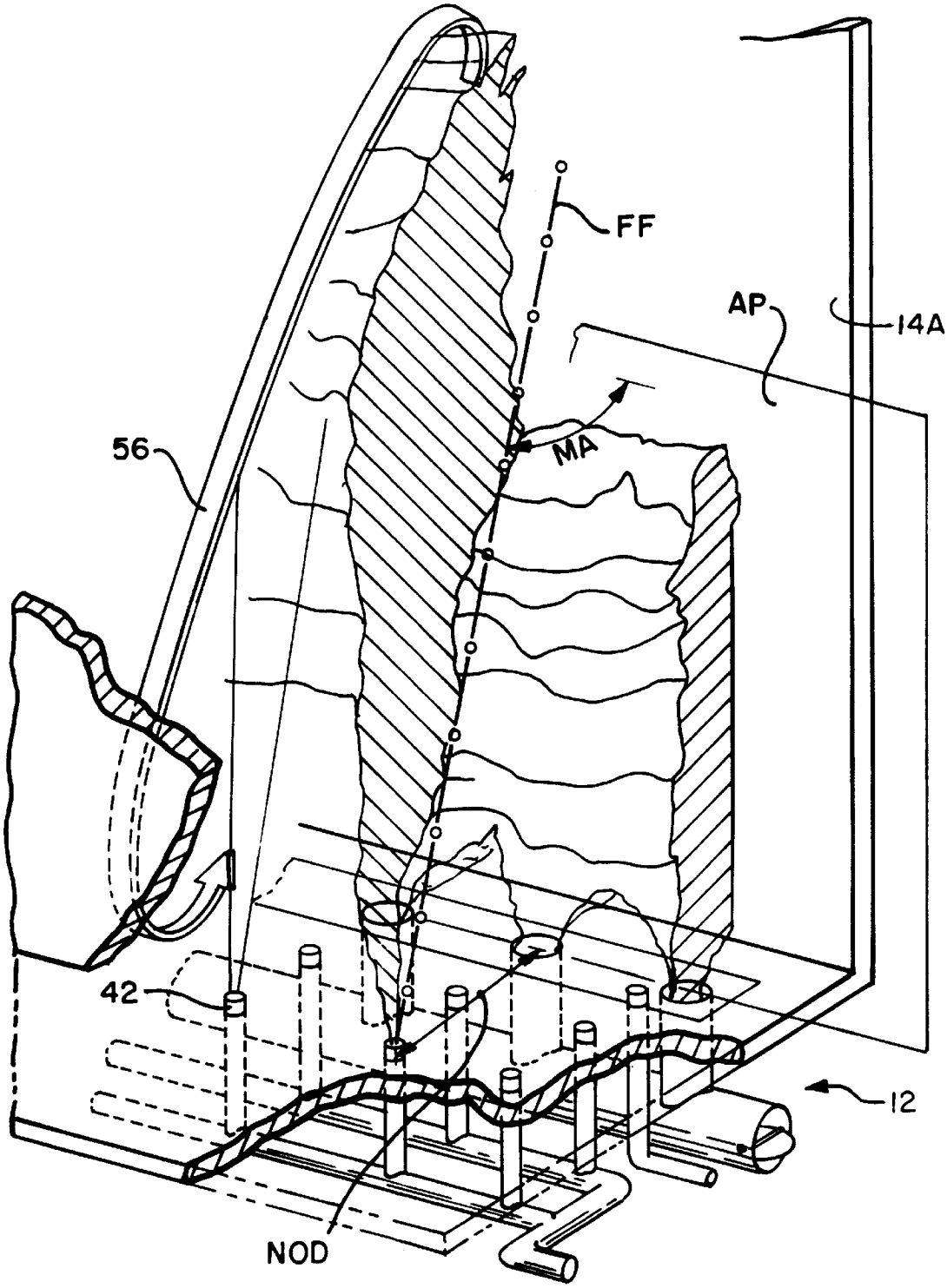
FIG. 5B is a perspective view of the one embodiment of the firing system of the thermal cracking furnace shown in FIG. 4B and schematically showing, in partial vertical section along lines VB—VB shown in FIG. 4B, the fuel and air introduced into the furnace interior by the firing system during a start up mode of operation.

Flue gas produced by the combustion process in the furnace follows a normal operation flue gas path 56, as seen in FIG. 5B, along which flue gas initially rises upward in the furnace immediately following its creation during the combustion process, thereafter circulates downwardly in a direction toward the radiant coils 22 (i.e., a counterclockwise direction), and subsequently is entrained with the fuel being introduced via the normal operation ports 42. The arrangement and operation of the normal operation ports 42 and the main air inlets 38 are preferably selected such that the normal operation flue gas path 56 extends sufficiently proximate to the floor 20 to ensure that any oxygen present on the floor 20 is entrained with the flue gas and, further, that the initial entrainment of the circulating flue gas (and the therewith entrained oxygen) and the fuel introduced via the normal operation ports 42 occurs at a location vertically above the ports. This arrangement ensures that the oxygen present on the floor 20 is not otherwise available to be entrained by the fuel issuing from the normal operation ports 42, which can lead to undesirable premature ignition of the fuel before the desired dilution. One approach to promote this desired circulation path of the flue gas is to orient the normal operation ports 42 such that the fuel issuing from the ports promote overall upward movement of the flue gas after it has swept the floor 20 in the region between the radiant coils 22 and the ports.

Figure 6:
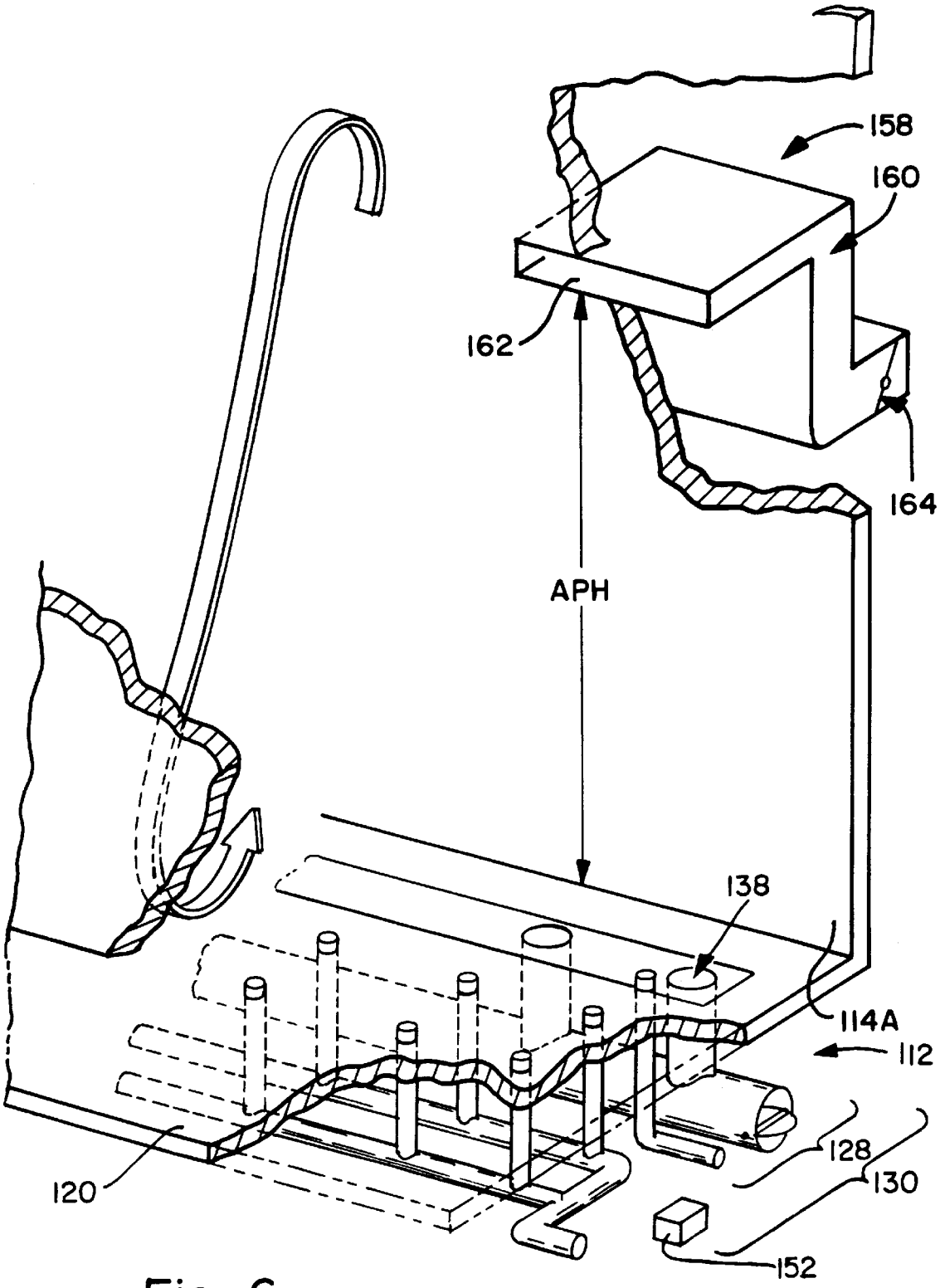
FIG. 6 is a perspective view, in partial horizontal and vertical section, of a thermal cracking furnace having another embodiment of the firing system of the present invention.

Another embodiment of the firing system of the present invention is illustrated in FIG. 6 and, for ease of reference, identical components of the furnace 10 illustrated in FIGS. 1–5 are designated in FIG. 6 with a "100" series of the reference numerals of these components in FIGS. 1–5. The another embodiment of the firing system, generally designated as 112, includes, in addition to the start up subsystem 128 and the normal operation subsystem 130, an overfire air subsystem 158 comprising an air plenum 160 having a rectangular lengthwise extending opening 162 extending through a compatibly shaped opening in the sidewall 114A at a height APH above the floor 120 and a damper assembly 164 which is operatively connected to the controller 152 for control thereby of the air flow through the air plenum 160. The height APH of the opening 162 of the air plenum 160 is selected as a function of an air staging arrangement for promoting reduced $NO_X$ formation in the furnace combustion process. Specifically, the height APH of the opening 162 is selected such that a portion of the air introduced into the furnace interior for mixing with the fuel is introduced as overfire air through the air plenum 160 for mixing with the rising fuel stream at a location downstream (i.e., above) the location at which the other portion of air introduced through the main air inlets 138 mixes with the fuel stream. This staging of the air creates a primary combustion zone having a nonstoichiometric condition at the upstream mixing location (the mixing of the air from the main air inlets 138 and the fuel stream) and a secondary combustion zone at the downstream location (the mixing of the air from the air plenum 160 and the uncombusted portion of the fuel-air mixture which has flowed upwardly from the upstream location). This air staging results in a desirable stepwise release of heat, thereby providing a capability to control the peak flame temperature and consequently influence and refine the heat flux in the furnace.

Figure 7:
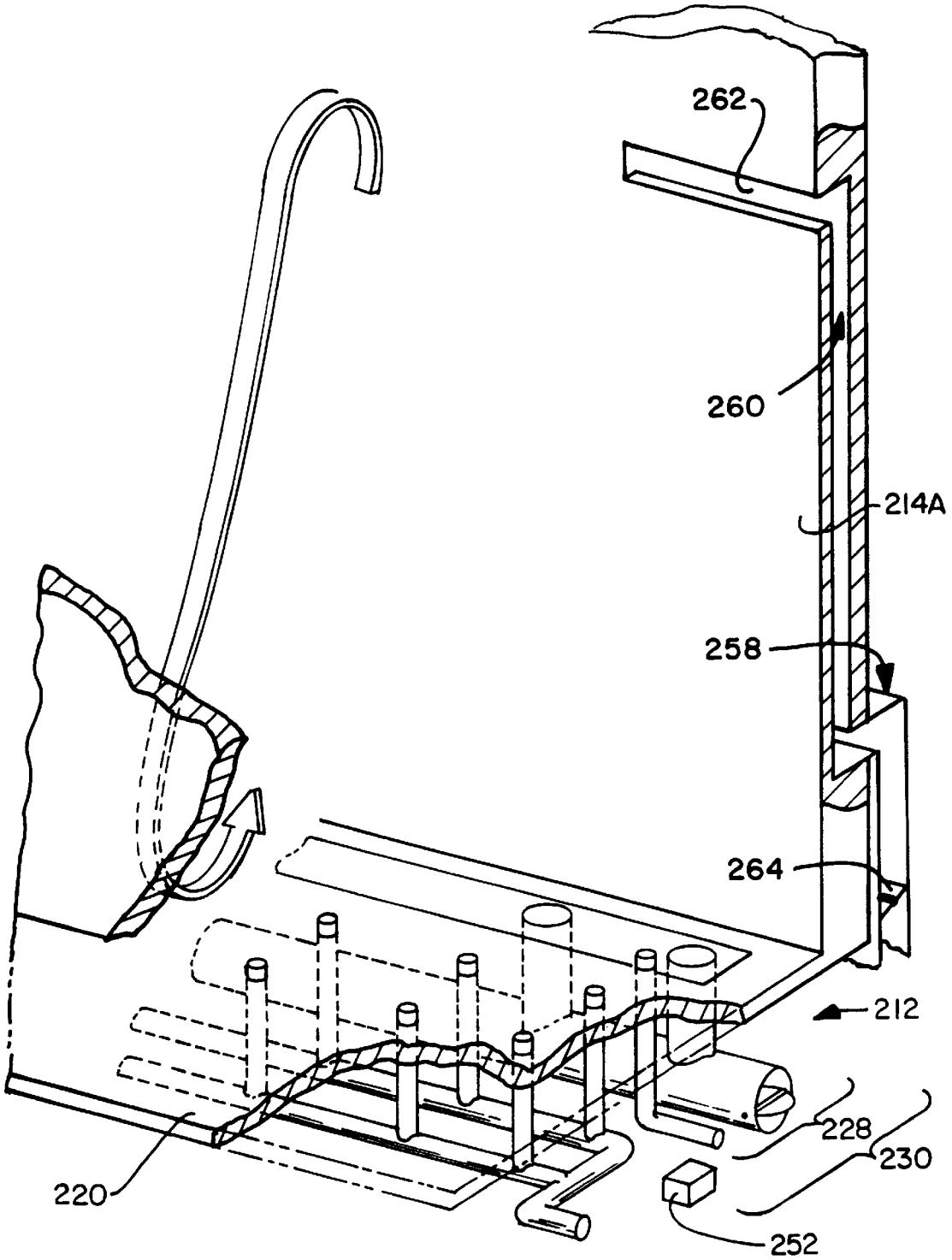
FIG. 7 is a perspective view, in partial horizontal and vertical section, of a thermal cracking furnace having a further embodiment of the firing system of the present invention.

A further embodiment of the firing system of the present invention is illustrated in FIG. 7 and, for ease of reference, identical components of the furnace 10 illustrated in FIGS. 1–5 are designated in FIG. 7 with a "200" series of the reference numerals of these components in FIGS. 1–5. The further embodiment of the firing system, generally designated as 212, includes, in addition to the start up subsystem 228 and the normal operation subsystem 230, an overfire air subsystem 258 comprising an air plenum 260 having a rectangular lengthwise extending opening 262 extending through a compatibly shaped opening in the sidewall 214A at a height APH above the floor 220 and a damper assembly 264 which is operatively connected to the controller 252 for control thereby of the air flow through the air plenum 260. A vertical portion of the air plenum 260 is mounted between the furnace interior surface and the furnace exterior surface of the sidewall 214A to provide the advantage of pre-heating of the air flowing through the air plenum due to heat transfer from the adjacent furnace interior surface of the sidewall 214A, as well as the advantage that the heat transfer to the air in the air plenum in this manner from the adjacent furnace interior surface of the sidewall 214A effects a cooling of this furnace interior surface. Since an extent of the furnace interior surface of the sidewall 214A from the floor 220 up to, for example, one third of the furnace height may typically be comprised in a hot zone, the cooling of this extent of the furnace interior surface of the sidewall promotes an improved heat flux profile and correspondingly lower $NO_X$ emissions.

Figure 8:
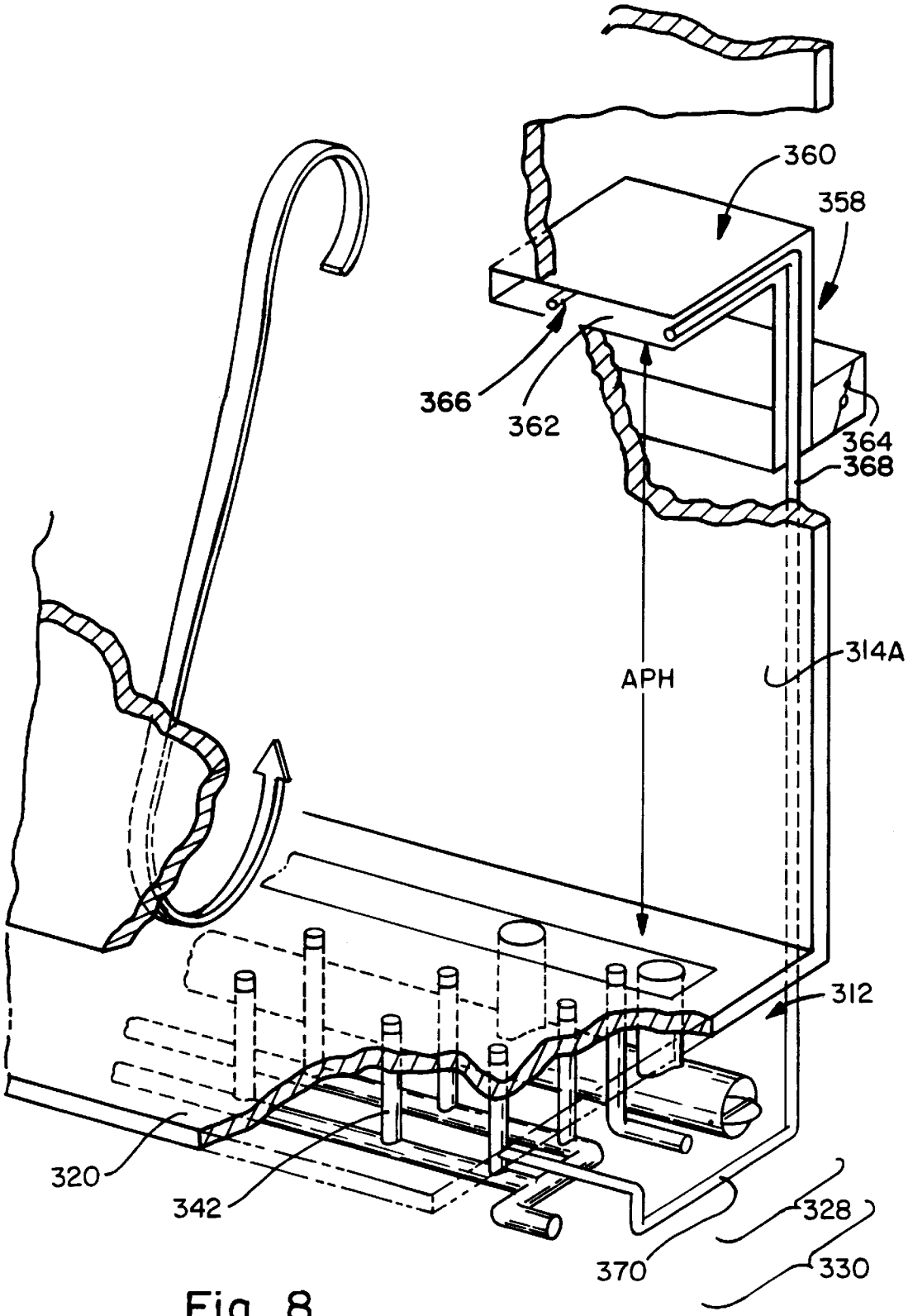
FIG. 8 is a perspective view, in partial horizontal and vertical section, of a thermal cracking furnace having an additional embodiment of the firing system of the present invention.

An additional embodiment of the firing system of the present invention is illustrated in FIG. 8 and, for ease of reference, identical components of the furnace 110 illustrated in FIG. 6 are designated in FIG. 8 with a "300" series of the reference numerals of these components in FIG. 6. The additional embodiment of the firing system, generally designated as 312, includes, in addition to the start up subsystem 328 and the normal operation subsystem 330, an overfire air subsystem 358 comprising an air plenum 360 having a rectangular lengthwise extending opening 362 extending through a compatibly shaped opening in the sidewall 314A at a height APH above the floor 320 and a damper assembly 364 which is operatively connected to the controller 352 for control thereby of the air flow through the air plenum 360. The firing system 312 further includes an overfire fuel subsystem 366 comprising a plurality of branch fuel lines 368 commonly communicated with a branch manifold 370 which itself is communicated at one end with one of normal operation ports 342 for the supply of fuel therefrom. Each branch fuel line 368 terminates in a tip which is supported in the interior of the air plenum 360 at an orientation such that overfire fuel is issued from the tip into the furnace interior generally at the height of the secondary combustion zone.

Figure 9:
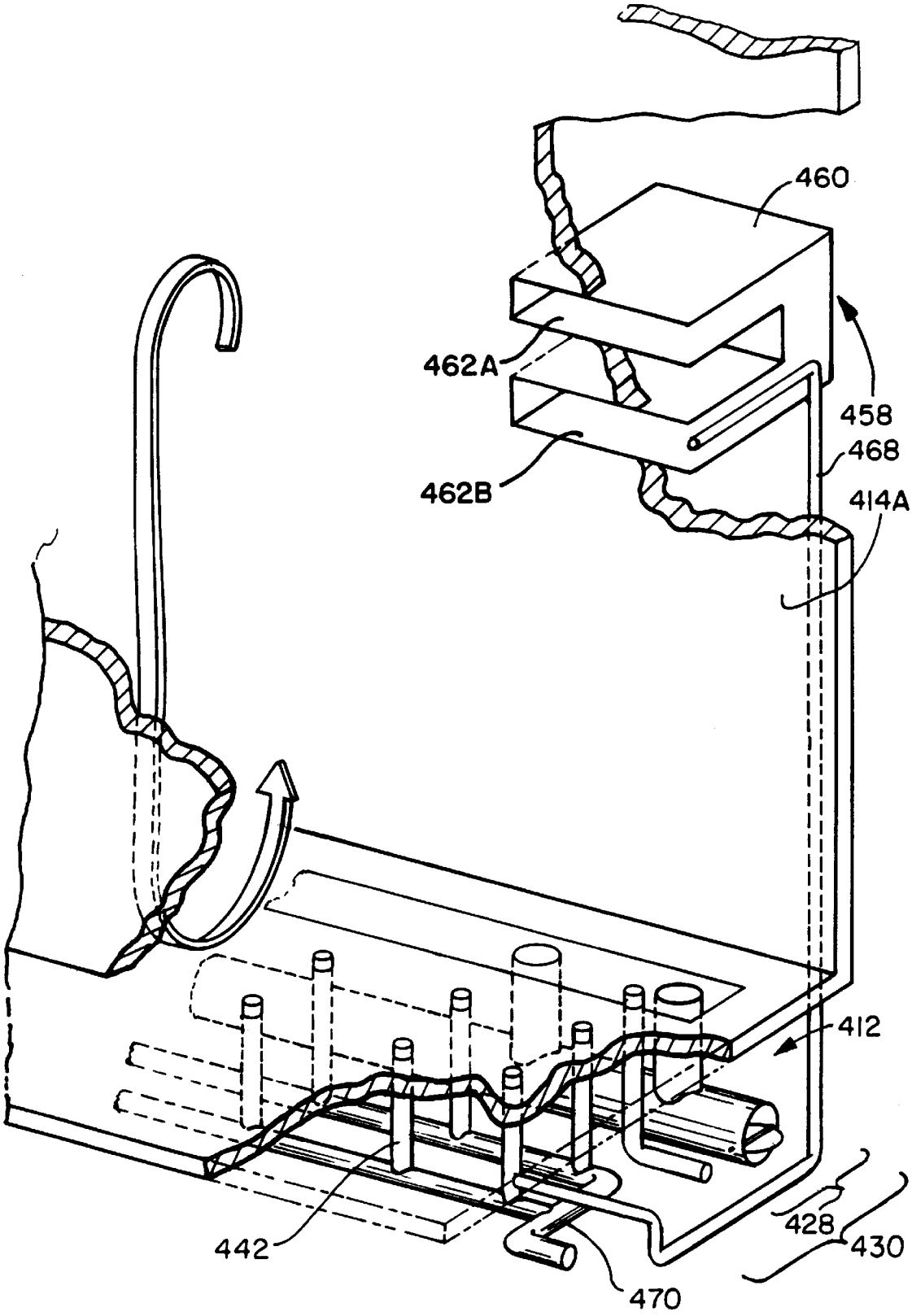
FIG. 9 is a perspective view, in partial horizontal and vertical section, of a thermal cracking furnace having a further additional embodiment of the firing system of the present invention.

A further additional embodiment of the firing system of the present invention is illustrated in FIG. 9 and, for ease of reference, identical components of the furnace 110 illustrated in FIG. 6 are designated in FIG. 9 with a "400" series of the reference numerals of these components in FIG. 6. The additional embodiment of the firing system, generally designated as 412, includes, in addition to the start up subsystem 428 and the normal operation subsystem 430, a sidewall flue gas recirculation subsystem 458 comprising an air plenum 460 having a rectangular lengthwise extending intake opening 462A and a rectangular lengthwise extending outlet opening 462B extending through compatibly shaped openings in the sidewall 414A. The firing system 412 further includes an overfire fuel subsystem 466 comprising a plurality of branch fuel lines 468 commonly communicated with a branch manifold 470 which itself is communicated at one end with one of normal operation ports 442 for the supply of fuel therefrom. Each branch fuel line 468 terminates in a tip which is supported in the interior of the lowermost one of the air plenum openings-namely, the opening 462B—at an orientation such that overfire fuel is issued from the tip into the furnace interior generally at the height of the secondary combustion zone. The intake opening 462A of the air plenum 460, which is above the outlet opening 462B, operates to draw in relatively cool, oxygen depleted flue gas which is subsequently inspirated by the fuel issuing from the tips of the branch fuel lines 468. The inspirated flue gas beneficially dilutes the fuel to thereby promote reduced $NO_X$.

Figure 10:
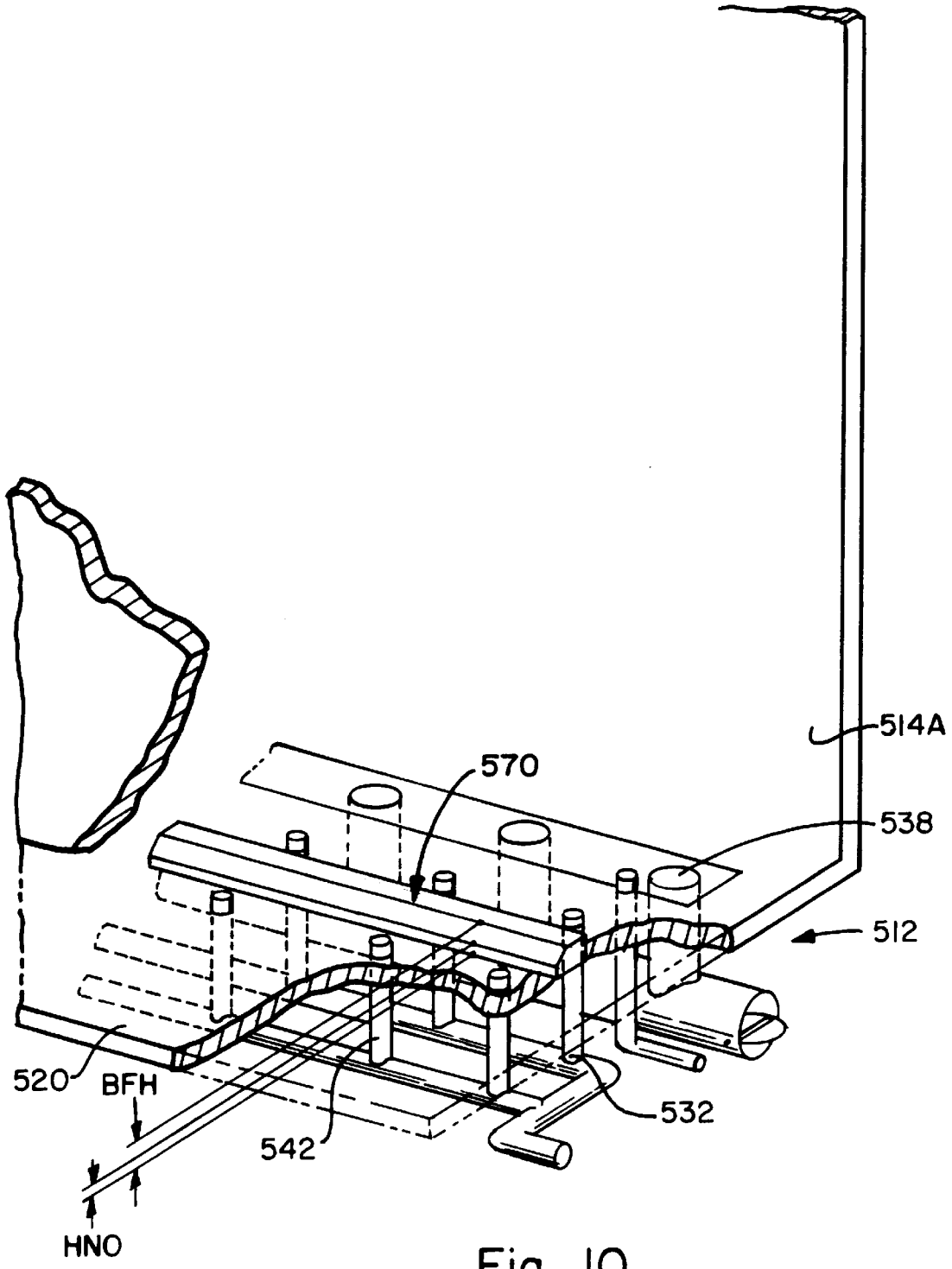
FIG. 10 is a perspective view, in partial horizontal and vertical section, of a thermal cracking furnace having a still further embodiment of the firing system of the present invention.

A still further embodiment of the firing system of the present invention is illustrated in FIG. 10 and, for ease of reference, identical components of the furnace 10 illustrated in FIGS. 1–5 are designated in FIG. 10 with a "500" series of the reference numerals of these components in FIGS. 1–5. The another embodiment of the firing system, generally designated as 512, includes a fuel separation wall 570 extending lengthwise along, and projecting above, the floor 520 at a location widthwise intermediate the row of the start up ports 532 and the normal operation ports 542. The fuel separation wall 570 has a height BFH selected as a function of the height HNO of the normal operation ports 542 above the floor 520 such that the wall promotes upward movement of fuel issuing from the normal operation ports 542 while reducing any tendency of the fuel to flow in a more horizontal direction toward the sidewall 514A and disadvantageously mix prematurely with air introduced through the main air inlets 538.

Figure 11:
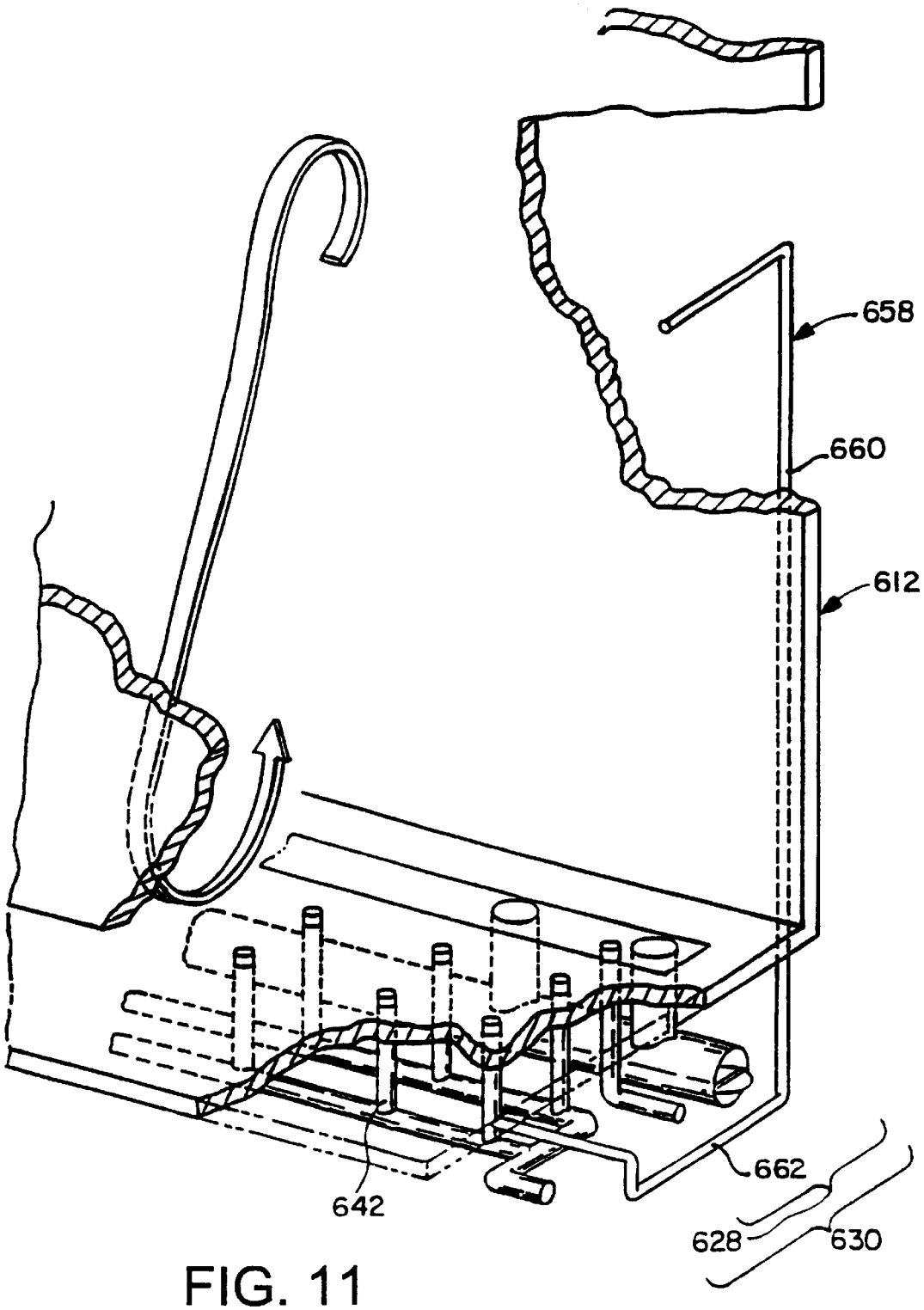
FIG. 11 is a perspective view, in partial horizontal and vertical section, of a thermal cracking furnace having a supplemental embodiment of the firing system of the present invention.

A supplemental embodiment of the firing system of the present invention is illustrated in FIG. 11 and, for ease of reference, identical components of the furnace 110 illustrated in FIG. 6 are designated in FIG. 11 with a "600" series of the reference numerals of these components in FIG. 6. The supplemental embodiment of the firing system, generally designated as 612, includes, in addition to the start up subsystem 628 and the normal operation subsystem 630, a sidewall fuel supply subsystem 658 comprising a plurality of branch fuel lines 660 commonly communicated with a branch manifold 662 which itself is communicated at one end with one of normal operation ports 642 for the supply of fuel therefrom. Each branch fuel line 660 terminates in a tip which is supported at an orientation such that overfire fuel is issued from the tip into the furnace interior generally at the height of the secondary combustion zone.

While several embodiments of the invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. A firing system for a thermal cracking furnace of the type having a furnace enclosure formed by a floor, a plurality of sidewalls, a row of radiant coils disposed in the furnace enclosure relative to a lengthwise extent thereof for passage therethrough of a material to be subjected to cracking, the row of radiant coils and a first one of the sidewalls being spaced from one another in a widthwise direction perpendicular to the lengthwise extent of the furnace enclosure, and a first portion of the floor extending widthwise between the first sidewall and the row of radiant coils, the firing system comprising:

a plurality of air inlets for introducing air into the furnace enclosure, the air inlets being generally arrayed along a lengthwise row on the first floor portion, the row of air inlets being at a predetermined widthwise spacing from the first sidewall;

a plurality of start up ports for introducing fuel into the furnace enclosure, the start up ports being generally arrayed along a lengthwise row on the first floor portion at a widthwise spacing from the row of air inlets and the start up ports and the air inlets being oriented relative to one another for introducing fuel and air, respectively, into the furnace enclosure such that the introduced fuel and air mix with one another;

a plurality of normal operation ports for introducing fuel into the furnace enclosure during a normal mode of operation, the normal operation ports being generally arrayed along a lengthwise row on the first floor portion which is intermediate the row of air inlets and the row of radiant coils and at a relatively greater widthwise spacing from the row of air inlets than the widthwise spacing between the row of air inlets and the row of start up ports, the normal operation ports being oriented such that the majority of the fuel introduced thereby is introduced in a direction inclined toward the first sidewall and the normal operation ports and the air inlets being oriented relative to one another to effect mixing of the introduced fuel and air with one another at a spacing above the first floor portion prior to ignition of the fuel and air mixture; and means for sequentially controlling the overall supply of fuel to the start up ports and the normal operation ports to effect supply of fuel solely to the start up ports during a start up mode of operation of the firing system and to thereafter effect supply of fuel to the normal operation ports during a normal mode of operation which follows the start up mode of operation.

2. The firing system for a thermal cracking furnace according to claim 1 wherein the row of start up ports is intermediate the row of air inlets and the row of radiant coils.

3. The firing system for a thermal cracking furnace according to claim 1 wherein the sum of the widthwise spacing of the row of normal operation ports from the first sidewall and the widthwise spacing of the row of air inlets from the first sidewall is between about one-eighth (⅛) and about three-quarters (¾) of the widthwise spacing of the row of radiant coils from the first sidewall.

4. The firing system for a thermal cracking furnace according to claim 1 and further comprising means for delivering supplemental air into the furnace enclosure at a location spaced above the first floor portion as measured along a height extent perpendicular to the lengthwise and widthwise extents of the furnace enclosure.

5. The firing system for a thermal cracking furnace according to claim 1 and further comprising means for delivering supplemental fuel into the furnace enclosure at a location spaced above the first floor portion as measured along a vertical extent perpendicular to the lengthwise and widthwise extents of the furnace enclosure.

6. The firing system for a thermal cracking furnace according to claim 1 wherein the air inlets introduce air into the furnace enclosure generally in a vertical direction perpendicular to the lengthwise and widthwise extent of the furnace enclosure.

7. The firing system for a thermal cracking furnace according to claim 1 wherein the row of start up ports is intermediate the row of air inlets and the row of radiant coils and the air inlets introduce air into the furnace enclosure generally in a vertical direction perpendicular to the lengthwise and widthwise extent of the furnace enclosure and further comprising means for delivering supplemental air into the furnace enclosure at a location spaced above the first floor portion as measured vertically and means for delivering supplemental fuel into the furnace enclosure at a location spaced above the first floor portion as measured vertically.

8. A method for controlling a firing system for a thermal cracking furnace, the thermal cracking furnace being of the type having a furnace enclosure formed by a floor, a plurality of sidewalls, a row of radiant coils disposed in the furnace enclosure relative to a lengthwise extent thereof for passage therethrough of a material to be subjected to cracking, the row of radiant coils and a first one of the sidewalls being spaced from one another in a widthwise direction perpendicular to the lengthwise extent of the furnace enclosure, and a first portion of the floor extending widthwise between the first sidewall and the row of radiant coils, the method for controlling the firing system comprising the steps of:

during a start up mode of operation, introducing air into the furnace enclosure through a plurality of air inlets which are generally arrayed along a lengthwise row on the first floor portion, the row of air inlets being at a predetermined widthwise spacing from the first sidewall;

during the start up mode of operation, introducing fuel into the furnace enclosure through a plurality of start up ports generally arrayed along a lengthwise row on the first floor portion at a widthwise spacing from the row of air inlets, the air being introduced through the air inlets and the fuel being introduced through the start up ports being introduced relative to one another such that the introduced fuel and air mix with one another;

following the completion of the start up mode of operation, introducing fuel during a normal mode of operation into the furnace enclosure through a plurality of normal operation ports generally arrayed along a lengthwise row on the first floor portion which is intermediate the row of air inlets and the row of radiant coils and at a relatively greater widthwise spacing from the row of air inlets than the widthwise spacing between the row of air inlets and the row of start up ports, the fuel being introduced through the normal operation ports at an orientation such that the majority of the fuel is introduced in a direction inclined toward the first sidewall and the normal operation ports and the air inlets being oriented relative to one another to effect mixing of the introduced fuel and air with one another at a spacing above the first floor portion prior to ignition of the fuel and air mixture; and sequentially controlling the overall supply of fuel to the start up ports and the normal operation ports to effect supply of fuel solely to the start up ports during the start up mode of operation of the firing system and to thereafter effect supply of fuel to the normal operation ports during the normal mode of operation which follows the start up mode of operation.

9. The method according to claim 8 and further comprising delivering air into the furnace enclosure at a location spaced above the first floor portion as measured along a height extent perpendicular to the lengthwise and widthwise extents of the furnace enclosure.

* * * * *